US007371159B2

(12) United States Patent
Kundig

(10) Patent No.: US 7,371,159 B2
(45) Date of Patent: May 13, 2008

(54) DEVICES WITH ANGULARLY ADJUSTABLE SANDING UNITS

(76) Inventor: Stephan Kundig, Haldenstr. 20, Rapperswil (CH) CH-8640

( * ) Notice: Subject to any disclaimer, the term of this patent is extended or adjusted under 35 U.S.C. 154(b) by 0 days.

(21) Appl. No.: 10/521,041

(22) PCT Filed: Jul. 22, 2002

(86) PCT No.: PCT/CH02/00045

§ 371 (c)(1),
(2), (4) Date: Nov. 23, 2005

(87) PCT Pub. No.: WO02/063937

PCT Pub. Date: Aug. 15, 2002

(65) Prior Publication Data

US 2006/0172661 A1 Aug. 3, 2006

(51) Int. Cl.
*B24B 21/06* (2006.01)

(52) U.S. Cl. ..... 451/300; 451/303

(58) Field of Classification Search ..... 451/303, 451/302, 301, 300, 299, 310, 296, 59
See application file for complete search history.

(56) References Cited

U.S. PATENT DOCUMENTS 3,701,219 A * 10/1972 Sternal ..... 451/300
4,601,134 A * 7/1986 Hessemann ..... 451/300
5,203,117 A * 4/1993 Jen ..... 451/296

FOREIGN PATENT DOCUMENTS

| | | | | |
|---|---|---|---|---|
| DE | 3029591 | * | 3/1981 | ..... 451/296 |
| DE | 3933697 | * | 4/1991 | ..... 451/296 |
| GB | 1437908 | * | 6/1976 | ..... 451/303 |
| JP | 1-115565 | * | 5/1989 | ..... 451/296 |

* cited by examiner

*Primary Examiner*—Robert Rose
(74) *Attorney, Agent, or Firm*—Adams Intellectual Property Law, P.A.

(57) ABSTRACT

The invention describes devices consisting of a combination of oblique to feed direction aligned belt sanding assemblies, with drives or devices for low sanding belt speeds and/or with conventional, or modified for sanding belt oblique operation, electronic segmented sanding pad. The oblique alignment of the sanding unit can be adjusted steplessly. Its application for both oblique sanding and, when so aligned, sanding directly in the direction of feed meets the requirements of intermediate sanding between paint or varnish coats, as well as those of wood sanding.

12 Claims, 3 Drawing Sheets

1
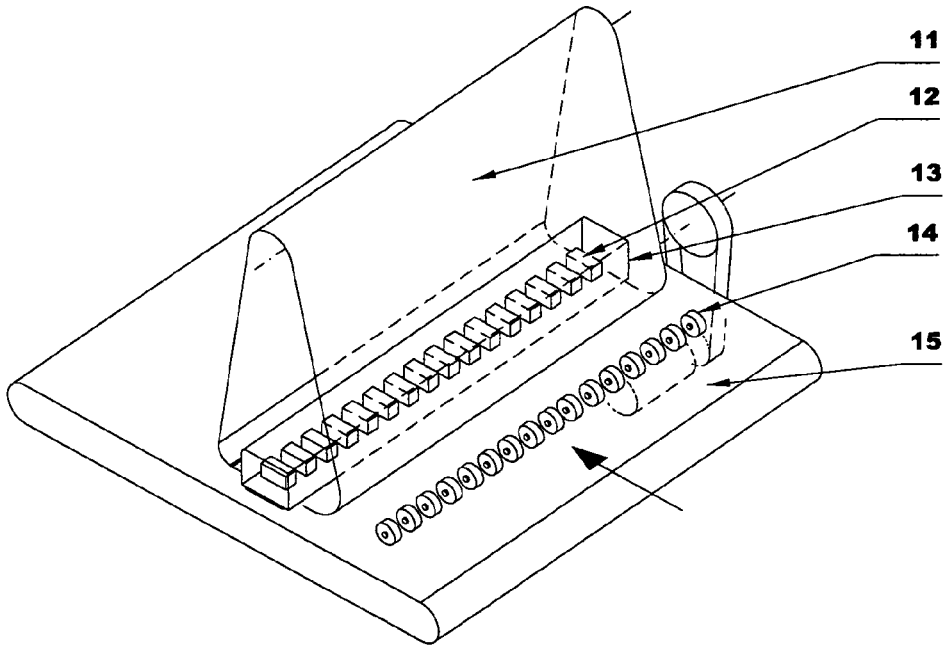
2
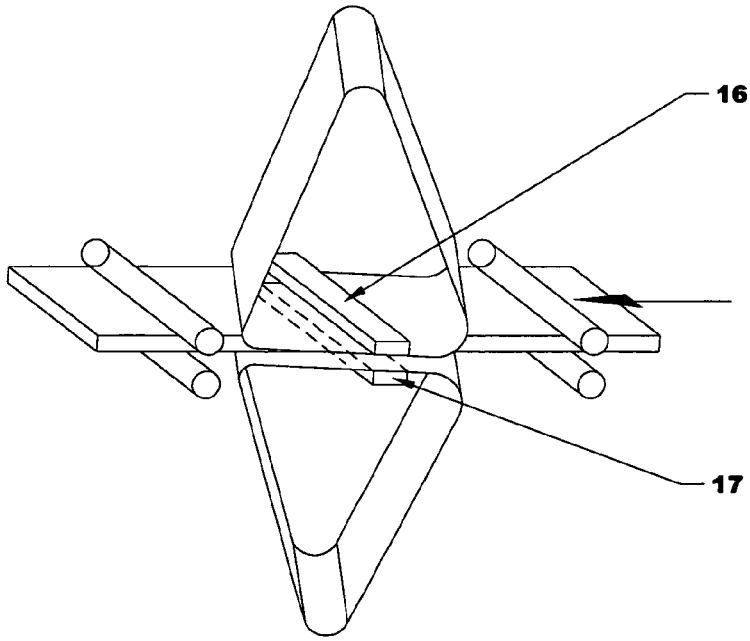

3
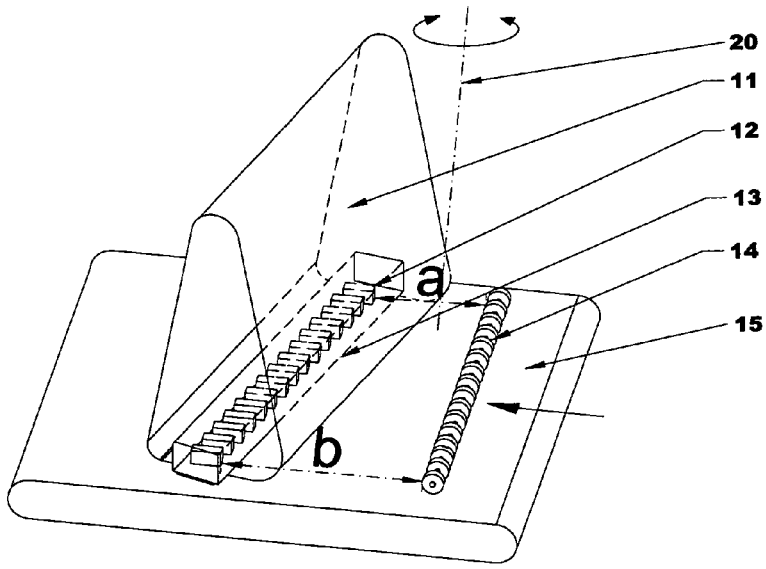
4
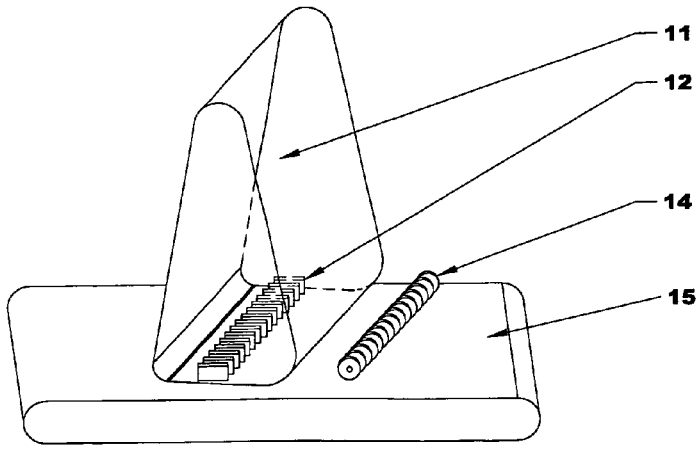

5
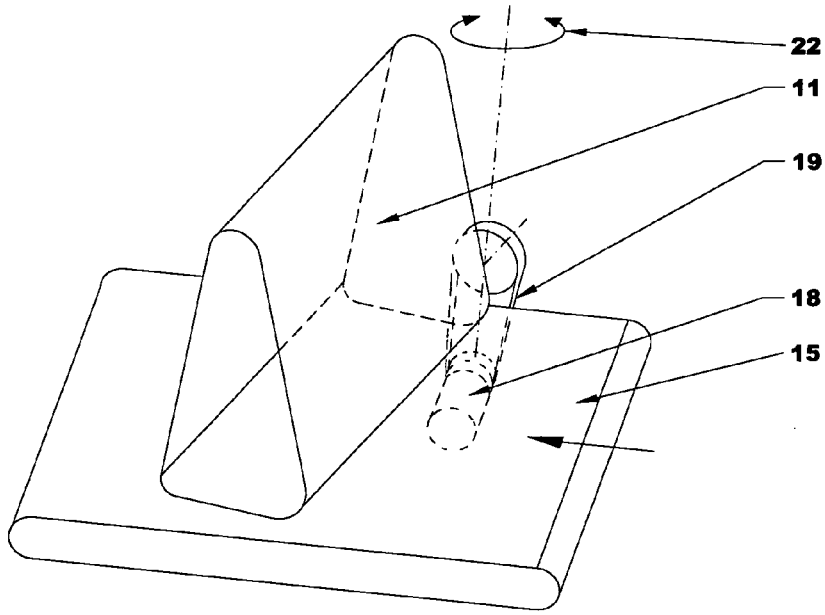
6
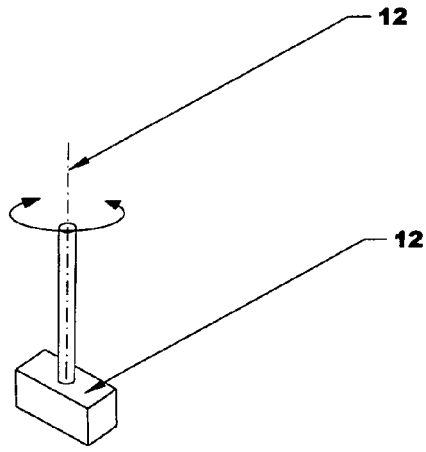

DEVICES WITH ANGULARLY ADJUSTABLE SANDING UNITS

This application is a national stage application, according to Chapter II of the Patent Cooperation Treaty.

BACKGROUND OF THE INVENTION

This invention describes previously unknown devices with obliquely alignable belt sanding units, previously unknown design characteristics of belt sanding units aligned obliquely, and previously unknown applications of devices with obliquely alignable belt sanding units.

BRIEF DESCRIPTION OF THE DRAWINGS

FIG. 1 illustrates a conventional sanding unit with sanding belt 11, a contact device, here in the form of a segmented sanding pad 13 made up of single segments 12, and a series of contact rollers 14 for controlling the segmented sanding pad, with a feed table 15.

FIG. 2 illustrates a top/bottom unit with sanding pads 16 and 17, which, contrary to the obliquely aligned sanding unit, are aligned perpendicularly to the feed direction.

FIG. 3 illustrates a sanding unit with its axis of rotation 20 aligned obliquely to its feed direction, here equipped with a segmented sanding pad 13, which is in the same oblique alignment as the unit as a whole, as is the series of contact rollers 14 for the control of the segmented sanding pad 13, which here is applied perpendicularly to the feed direction. Due to this arrangement of contact rollers 14, differing from the oblique alignment of the segmented sanding pad 13, the distances vary along the working width between the individual contact rollers and the corresponding segments controlled by them. Section a is therefore shorter than section b.

FIG. 4 illustrates the same representation of the sanding pad as FIG. 3, but with a contact roller series 14 in the same oblique alignment as the sanding assembly.

FIG. 5 shows illustrates an obliquely alignable unit with a motor 18 for rotation 22 and drive belt 19.

FIG. 6 shows illustrates a single segment 12 of a segmented sanding pad with its axis of rotation 21.

DETAILED DESCRIPTION OF THE INVENTION

The current state of technology includes top/bottom sanding systems with belt sanding units which are aligned slightly obliquely to the feed direction. The two pressure beams, required to establish contact between the workpiece and the sanding belt, referred to as sanding pads 16 and 17, are aligned at 90° to the workpiece. This 90° alignment of the sanding pad for the obliquely aligned sanding belt requires a sanding unit which affords a large amount of space, but which can guarantee a straight workpiece throughfeed even when there is an interruption to the workpiece surface, which is unavoidable for sanding operations from below.

It is also known in professional circles that sanding belts obliquely aligned to the feed direction have the advantage over those which work straight in the feed direction, that any imperfections (e.g. sawdust, knot fallout, contamination with glue, dust, etc.) do not lie in straight lines, but rather repeat laterally along the workpiece. They therefore appear less serious and frequent. The oblique sanding marks themselves are not disturbing on homogeneous workpieces or those which are treated further after sanding (lamination, coating, etc.), though naturally not on structured surfaces (e.g. grained timber). Sanding with obliquely aligned belts is therefore not common. An exception are the above-mentioned top/bottom sanding units. And even with these the application is limited to MDF panels with high surface quality requirements. No such requirements for flawless surface quality exist. However for e.g. chip board (these are usually subsequently veneered), while veneer or solid wood, as mentioned, normally do not tolerate any sanding marks. An advantage of obliquely aligned sanders becomes evident with intermediate sanding between paint or varnish coats. For this to date unknown application other preconditions have had to be fulfilled: part of this invention is that previously, due to the thinner paint or varnish coat, the obliquely aligned sanding unit was applied at lower sanding belt abrasive speeds (i.e. about 50% or less than the standard speed for high-grade abrasion of around 20 m/s) and/or a specially thin sanding pad. The corresponding devices—e.g. RPM regulation via a frequency converter and the use of electronically controlled segmented sanding pads are known, but not their combination or simultaneous application with obliquely aligned sanders.

To the contrary of industrial panel finishing (e.g. MDF panels), coating and intermediate coat sanding is undertaken mostly in medium-sized businesses. These have special requirements: mainly that the same unit should sand wood panels (solid or veneer) and coated surfaces. While the straight sand is the first requirement, the oblique sand option offers the nominated advantages to surface finishing. The sanders must therefore, as this invention describes, be adjustable. Should the sanding pad also be aligned obliquely, as in the case of segmented sanding pads, then there must also be an automatic switchover from straight to oblique (and vice-versa) of the electronic segmented sanding pad segments 12 around their axis of rotation 21. Since their application is controlled at infeed by means of contact rollers 14, the control must also be made "obliquely alignable". This is achieved either through the use of a segmented pressure or contact roller series 14, which rotates parallel to the sanding unit (and which aligns e.g. via a parallelogram suspension aligned in the feed direction), or in the case of contact roller fixed position, via a regulated compensation across the working width of the varying section gap between contact rollers and segments.

What is claimed is:

1. A sanding device, comprising:

a feed table defining a feed direction for feeding a workpiece into the device;

a sanding unit comprising a sanding belt and a segmented sanding pad including a plurality of rotatable sanding pad segments; and a plurality of contact rollers for controlling the application of the plurality of rotatable sanding pad segments;

wherein the sanding unit is steplessly movable between a first position in perpendicular alignment with the feed direction and a second position in oblique alignment with the feed direction;

wherein the plurality of contact rollers move in parallel with the sanding unit; and wherein the sanding pad segments remain parallel with the feed direction in both the first and second positions and positions therebetween.

2. A sanding device in accordance with claim 1, wherein the segmented sanding pad is electronically controlled.

3. A sanding device in accordance with claim 1, wherein the plurality of contact rollers are selectively movable between a perpendicular alignment with the feed direction and an oblique alignment with the feed direction.

4. A sanding device in accordance with claim 1, further comprising a drive motor.

5. A sanding device in accordance with claim 4, wherein RPM regulation of the drive motor is controlled via a frequency converter and sanding at the oblique alignment is at a rate of about 10 m/s or less.

6. A sanding device in accordance with claim 1, wherein a path distance between each one of the plurality of sanding pad segments and each one of the corresponding plurality of contact rollers is the same when the sanding unit is in both the perpendicular alignment and the oblique alignment with the feed direction.

7. A sanding device, comprising:

a sanding unit comprising a sanding belt and a segmented sanding pad including a plurality of individually rotatable sanding pad segments; and a plurality of contact rollers for controlling the application of the plurality of rotatable sanding pad segments;

wherein the sanding unit is selectively movable between a perpendicular alignment with a feed direction for feeding a workpiece into the device and an oblique alignment with the feed direction;

wherein the plurality of contact rollers move in parallel with the sanding unit;

wherein a path distance between each one of the plurality of sanding pad segments and each one of the corresponding plurality of contact rollers is the same when the sanding unit is in both the perpendicular alignment and the oblique alignment with the feed direction.

8. A sanding device in accordance with claim 7, wherein the sanding unit and the plurality of contact rollers are steplessly movable.

9. A sanding device in accordance with claim 7, wherein the segmented sanding pad is electronically controlled.

10. A sanding device in accordance with claim 7, wherein the plurality of contact rollers are selectively movable between a perpendicular alignment with the feed direction and an oblique alignment with the feed direction.

11. A sanding device in accordance with claim 7, further comprising a drive motor and wherein RPM regulation of the drive motor is controlled via a frequency converter.

12. A sanding device in accordance with claim 7, wherein the plurality of rotatable sanding pad segments are rotatable to maintain them parallel to the feed direction when the sanding unit is in the oblique alignment.

* * * * *